United States Patent [19]

Van Pelt, Jr.

[11] 4,203,235

[45] May 20, 1980

[54] SKI TRAINING DEVICE

[76] Inventor: R. Harrison Van Pelt, Jr., 679 S. Reed Ct., A-2, #401, Lakewood, Colo. 80226

[21] Appl. No.: 877,941

[22] Filed: Feb. 15, 1978

[51] Int. Cl.[2] ..... A43B 5/04

[52] U.S. Cl. ..... 36/118; 36/121

[58] Field of Search ..... 36/118, 119, 120, 121, 36/117, 132

[56] References Cited

U.S. PATENT DOCUMENTS

| | | | |
|---|---|---|---|
| 3,807,060 | 4/1974 | Hanson et al. | 36/118 |
| 3,854,743 | 12/1974 | Hanson | 36/121 |
| 4,030,214 | 6/1977 | Hanson et al. | 36/118 |

*Primary Examiner*—Patrick D. Lawson

*Attorney, Agent, or Firm*—Cushman, Darby & Cushman

[57] ABSTRACT

The disclosure embraces a low-rise ski boot and an accessory for insertion into the rear portion of a regular ski boot to assist a user in assuming the correct leg positions when skiing and includes a first member which is formed with or inserted into the boot between the rear portion thereof and the user's leg, a second member which is pivotally attached to the first member and which is curved to conform to the rear portion of a person's leg in the vicinity of the calf; a pair of adjustable wedge members having converging surfaces are mounted on the device for insertion between the first and second members whereby, when the converging surfaces are inserted between the first and second members, the calf engaging member will assume an angular position with respect to the ski boot tending to maintain the user's leg in the proper angular orientation relative to the ski.

8 Claims, 6 Drawing Figures

Fig. 5.
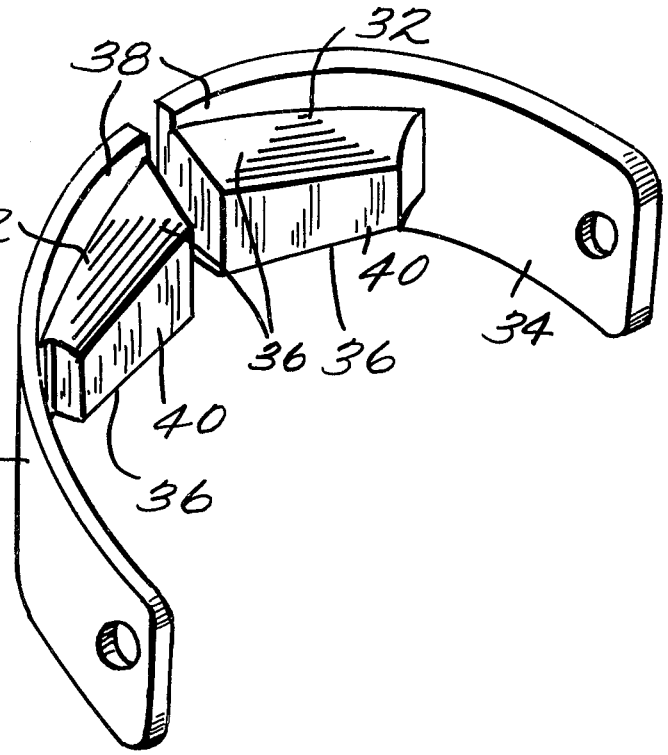
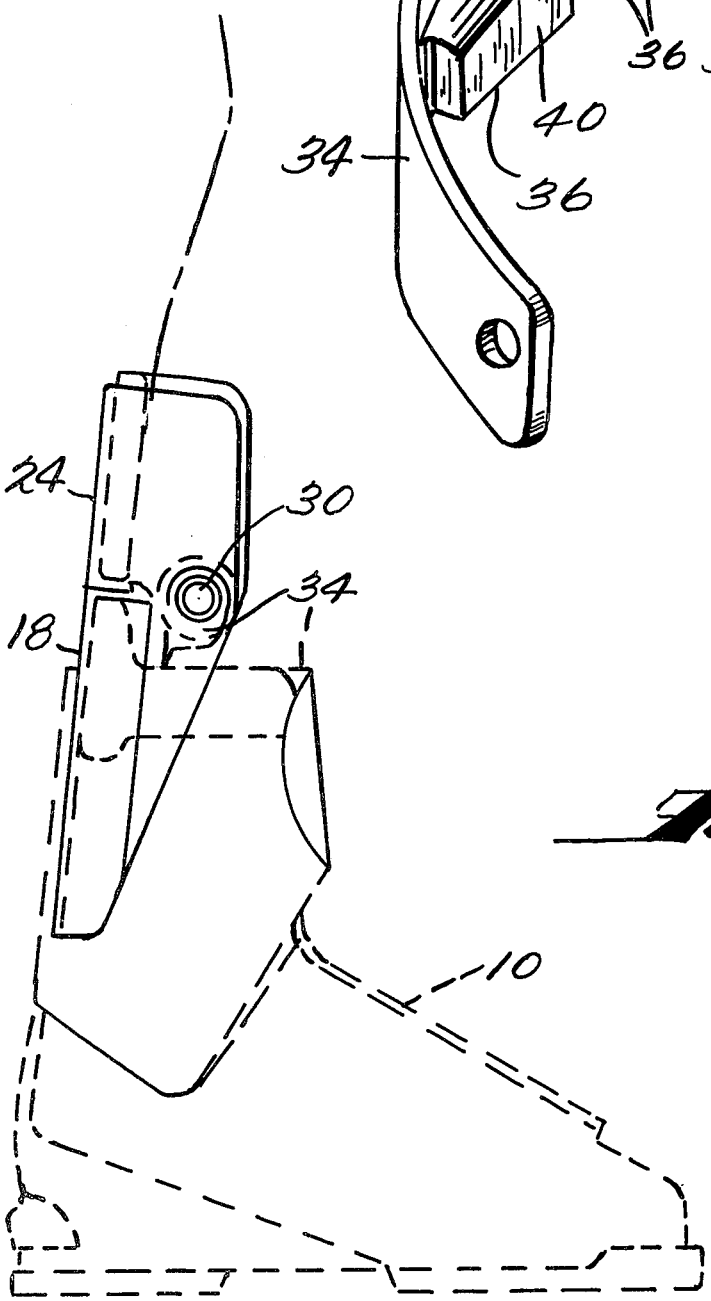
Fig. 4.

SKI TRAINING DEVICE

BACKGROUND AND BRIEF DESCRIPTION OF THE INVENTION

The present invention relates to a low rise boot and an accessory training device for use with ski boots and more particularly to a device that will assist a person learning to ski in positioning his or her legs relative to the ski for proper balance and safe maneuverability.

In this field, there exists a number of proposals involving the designs of ski boots to assist learners in assuming the correct posture and leg position while skiing. However, many of the proposed designs have rendered the ski boot either uncomfortable or unsafe for wear after a user has gained some proficiency in skiing. In other designs, there has been no provision for flexibility in the training boot to accommodate a large number of persons of differing sizes and weights.

In view of the considerable expense required in the purchase of a properly fitting set of ski boots, persons desiring to learn to ski have been reluctant to invest in the purchase of a pair of training boots, not only in view of their expense, but also in view of the relatively short period of use persons obtain from such trainer boots. As a result, greater time has been required to learn the proper leg positions and such learning procedures, without suitable training boots, have increased the likelihood of injury to a novice.

The purpose of the present invention is to overcome the foregoing drawbacks by providing an adjustable low-rise boot and an accessory for a regular ski boot which will assist a learner in assuming the proper leg positions relative to the ski. The accessory is distinguished by the fact that it can be easily inserted and removed from a regular ski boot after the leg positions have been mastered. Further, the accessory device of the present invention either in a low-rise boot or in its accessory form can be adjusted to accommodate different users, thus reducing its manufacturing cost. In addition, since the accessory form of the present invention is easily inserted into a boot, and can be inexpensively manufactured, it will be useful for skiers who have abstained from skiing for a period of time and who require a short training period before returning to the sport.

In summary, the present invention provides an adjustable leg support for canting the leg of a user relative to the ski which, in the accessory embodiment, has a tongue which can be inserted between the rear portion of a regular ski boot and the user's leg. The accessory device is intended to be used with regular ski boots which have a built-in forward lean structure relative to a ski and which cover the ankle. The low-rise training boot embodiment is designed primarily for a boot shape that does not incorporate a forward lean structure and which many persons use as training boots. In both embodiments, a canting member is provided with ear portions which are pivotally secured to the upper portion of the low-rise boot, in this embodiment, and to the upper portion of the tongue member in the accessory embodiment. Between the pivot connections of the canting member, adjustable wedging means are secured so as to be movable between the lower edge of the canting member and the upper rear edge of the boot or the upper rear edge of the tongue in the accessory form. With the wedge member inserted underneath of the canting member, the canting member will assume an angular position relative to the training boot or regular ski boot which will induce the user's leg to assume the proper canted position relative to the ski. The wedging members can be adjusted to vary this angular position or can be entirely removed from between the canting member, and tongue member or upper edge of the rear boot so that the canting member will not interfere with normal walking when the training device is not in use.

The foregoing and other objects and advantages of the present invention will become apparent as consideration is given to the following detailed description taken in conjunction with the accompanying drawings, in which:

BRIEF DESCRIPTION OF THE DRAWINGS

FIG. 4 is a view similar to FIG. 1 showing the training device of FIG. 1 in its free position;

FIG. 5 is a perspective view of one of the wedge members of the present invention.

DETAILED DESCRIPTION OF THE INVENTION

Figure 1:
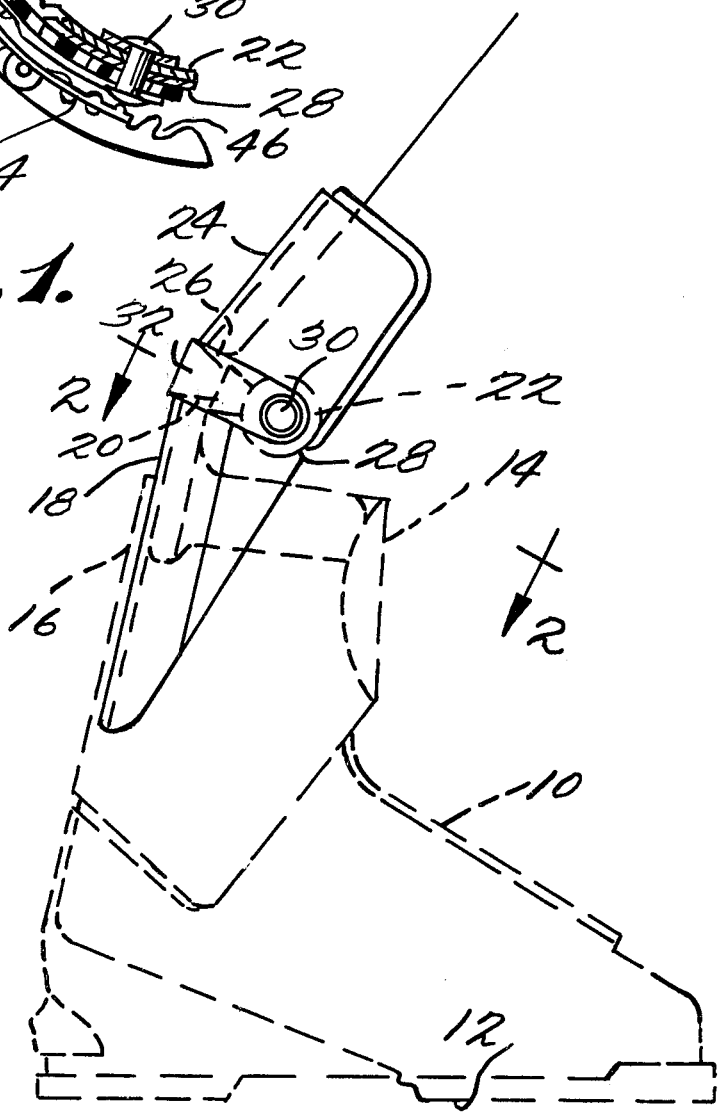
FIG. 1 is a side view in elevation of the accessory embodiment of the training device of the present invention.

Referring now to the drawings, wherein like numerals designate corresponding parts throughout the several views, there is shown in FIG. 1, a regular ski boot 10 having a flat base 12 which when the boot is installed on the ski, will lie parallel to the plane of the ski. The boot 10 has an ankle portion 14 which is canted between 10 and 20 degrees from the perpendicular to base 12. While other angular positions are employed in special boots such as racing boots or for other types of competition, it will be understood that the accessory embodiment of the present invention can be used with a broad range of the type of high-rise, i.e., ankle covering, ski boot.

Shown inserted into the rear portion 16 of the ankle portion 14, is an abutment member in the form of a tongue 18 which is preferably curved or semicircular in cross section to conform to the user's leg. The tongue member 18, along its upper edge, is provided with an abutment area in the form of a flange 20 which terminates on opposite sides of the tongue in projecting ear portions, one of which is shown at 22.

A second member in the form of a canting member 24 is provided, along its lower edge, with an abutment surface which also is in the form of a flange 26 which extends between two ear portions, one of which is shown at 28. The ear portions of the tongue member 18 and the canting member 24 overlap and each are provided with apertures through which a rivet 30 is passed to pivotally secure the respective ear portions and thereby the canting member 24 and tongue 18 together. With this arrangement, as thus far described, it will be appreciated that the canting member 24 can be rotated about the respective rivets 30 to move the flanges 20 and 26 towards and away from each other, as desired.

Figure 2:
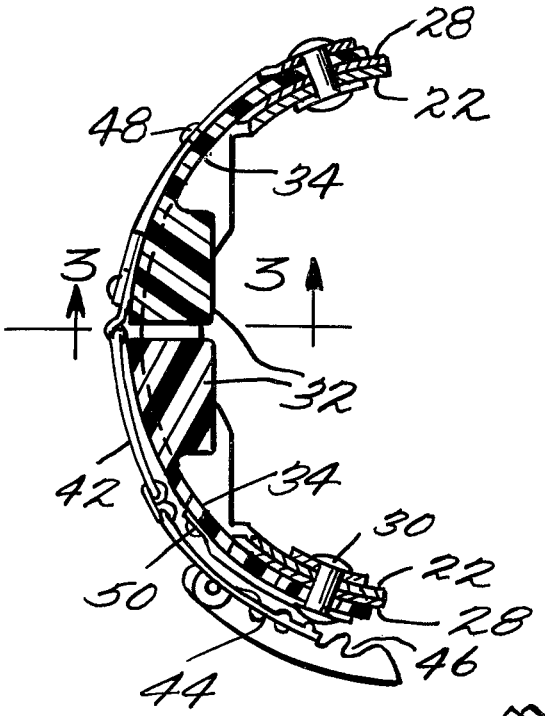
FIG. 2 is a view taken along lines 2—2 of FIG. 1.

As more clearly shown in FIG. 2, according to the present invention, means for limiting the distance of closest approach between flanges 20 and 26 is provided in the form of wedge members 32, each of which are identically shaped to include an arm 34 which, at its end remote from the wedge member 32, is provided with an aperture through which rivet 30 is passed so that the wedge member is pivotable about the axis of rivet 30. The attachment of the arms 34 to the rivets 30 should be relatively loose so that the wedge members 32 may be moved easily toward and away from each other so that their positions between the flanges 20 and 26 can be adjusted as desired. Of course, another manner of achieving this is to manufacture the arms 34 from relatively flexible material, whereas the wedge members 32 are preferably constructed from very hard plastic such as high molecular weight polypropylene.

As seen more clearly in FIG. 1, and more particularly in FIG. 5, the wedge members 32 each have surfaces 36 which converge towards each other from the base 38 of the wedge member 32, towards an inner surface 40.

Figure 3:
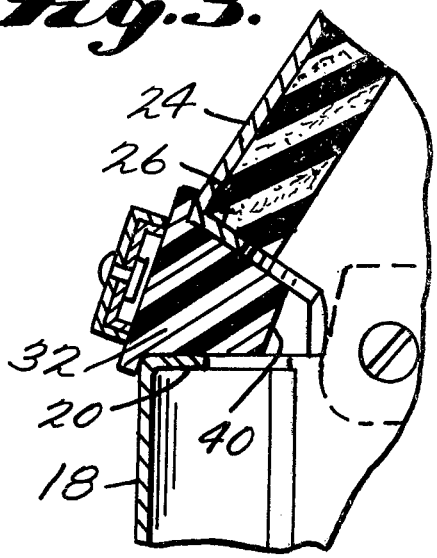
FIG. 3 is a view taken along lines 3—3 of FIG. 2 with parts broken away.

As shown in FIG. 3, the converging angle between surfaces 36 will determine the resultant angular orientation of the canting member 24 relative to the tongue 18 with the parts assembled and positioned in the boot as illustrated in FIG. 1.

Referring now to FIG. 2, again, a locking means in the form of a strap 42 and buckle 44 together with clasp 46 are provided to adjust the degree of insertion of the converging surfaces 36 of the wedge members 32 between the flanges 20 and 26 of the tongue 18 and canting member 24. The strap 42 has one end preferably secured on rivet 30 on one side of the canting member 24 while the clasp 46 is secured on the opposite side of the canting member 24 also to the rivet 30. Preferably, the arms 34 of the wedge members are secured respectively to the strap 42 as at 48 and to the base of the clasp 46 as at 50, with the pins 48 and 50 being spaced a distance from the rivets 30. With this arrangement, disposing the end of the buckle 44 in one of the various notches of the clasp 46 will serve to maintain the wedge members 32 in a fixed position relative to the rivets 30 and thus to the flanges 20 and 26.

Referring now to FIG. 4, it will be seen that when the clasp 44 and buckle 42 are separated, the wedge members can be entirely removed from between the flanges 20 and 26 so that the canting member 24 may be pivoted to bring its flange 26 into contact with the flange 20 of tongue 18 to minimize interference with normal walking.

Figure 6:
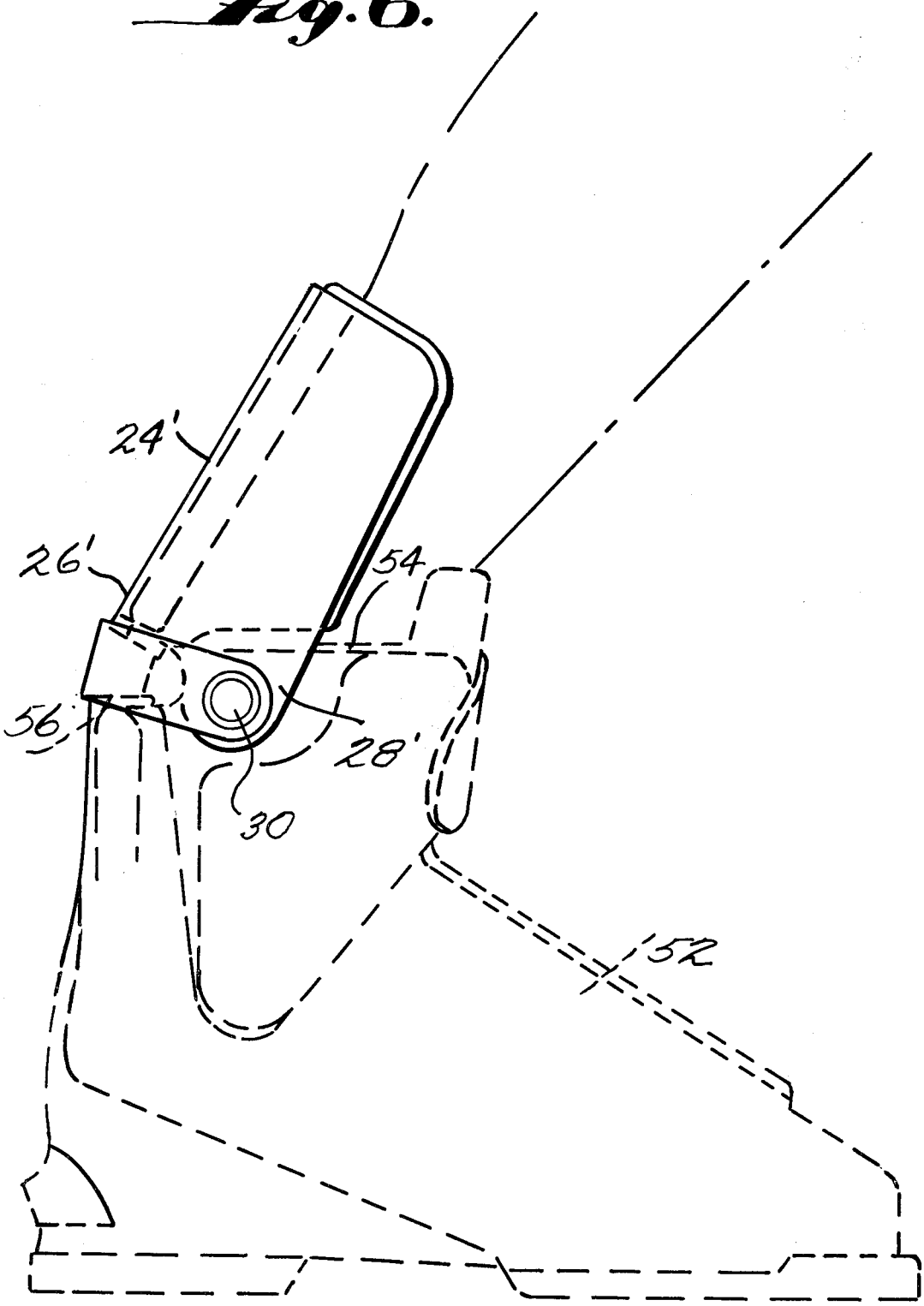
FIG. 6 is a side view in elevation of a training boot embodying the principles of the present invention.

Referring now to FIG. 6, there is shown a low-rise boot 52 which has a lower profile than the regular ski boot of FIG. 1 in that the top edge 54 of the boot 52 does not rise as high along the wearer's leg. With such boots, the use of a tongue insert such as the tongue 18 in the embodiment of FIG. 1 is impractical due to the reduced height of the boot. However, the rear edge 56 of such boots is rigid enough to serve as an abutment member and to perform the same function as the flange 22 of the accessory embodiment of FIG. 1. Thus, according to the embodiment of FIG. 6, the ear portions 28' of the canting members 24' are pivotally secured adjacent the top on the sides of the boot 52 in a manner similar to the connection between canting member 24 and tongue 18 in the embodiment of FIG. 1. Thus a rivet 30' passes through the ear portions 28' and corresponding ear portions formed in the material of the boot 52. The longitudinal length of the canting member 24', however, should be slightly greater than the length of the canting element 24 of the FIG. 1 embodiment so that the inside surface of the canting element 24' will rest adjacent the calf of the wearer. The limit means in the form of the wedge members 32, as well as the locking means, will be identical to that of the accessory embodiment of FIG. 1 and, therefore, will not be described. Also, the operation of the wedge members and locking elements is the same as for the previous embodiment so that the canting member 24' may be pivoted back to bring its flange 26' into contact with the top edge 56 of the boot to minimize interference with normal walking.

With the device of the present invention, a user's leg will be properly canted at about 45 degrees relative to the plane of a ski. By the use of the wedge members, adjustability is provided to accommodate individual users to obtain a canting angle that is either slightly larger or smaller than the usually preferred 45-degree angle. With the limit means in the form of the wedge members 32 removed, normal walking in the ski boots will be made easier than would be the case where the structure of the ski boot itself was relied upon to induce the wearer's leg to assume a 45-degree angle relative to the ski.

While the foregoing has been a description of the preferred embodiments of the present invention, it will be understood by those skilled in this art that various modifications may be made thereto without departing from the spirit and scope of the present invention as defined in the appended claims.

I claim:

1. An accessory device for canting the leg of a user relative to a ski comprising an abutment member including a pair of ear portions located on opposite sides of said abutment member, said abutment member and ear portions being located adjacent the upper rear portion of a ski boot, a canting member having a leg engaging portion, an abutment surface at one end of said leg engaging portions and a pair of ear portions each located on opposite sides of said abutment surface, each ear portion on opposite sides of said abutment member being pivotally connected, respectively, to an ear portion of said pair on the opposite sides of said abutment surface so that said canting member is pivotable relative to said abutment member to move said abutment surface toward and away from said abutment member, limit means attached to said canting member so as to be insertable between said abutment member and surface, said limit means including at least two surfaces which converge from a base toward each other, one of said converging surfaces being engageable by said abutment member and the other of said converging surfaces being engageable by said abutment surface when said limit means is inserted between said abutment member so that, when said abutment surface is moved toward said abutment member, the closest distance assumable between said abutment member and surface is determined by the extent to which said surfaces of said limit means are positioned therebetween, said limit means further including means for locking said surfaces in a selected position relative to said abutment surface and member.

2. The device as claimed in claim 1 wherein said abutment member and ear portions located on the opposite sides thereof are formed integrally with said upper rear portion of said ski boot.

3. The device as claimed in claim 1 wherein said limit means is pivotally attached to said ear portions of said canting member.

4. An accessory training device for use with a ski boot for canting the leg of a user relative to the ski, said device comprising:

a first member having a tongue portion for insertion into a ski boot between the rear of a user's leg and the inside rear portion of the boot, said first member having at one end thereof a flange and a pair of ear portions each located on opposite sides of said flange, a second member having a leg engaging portion, a flange at one end of said leg engaging portion and a pair of ear portions each located on opposite sides of said flange of said second member, each ear portion of said pair of said first member being pivotally connected, respectively, to an ear portion of said pair of said second member so that said first and second members are pivotable relative to one another to move said flanges of said members toward and away from each other, limit means attached to one of said members so as to be insertable between said flanges of said members, said limit means including at least two surfaces which converge from a base toward each other, each surface being engageable by one of said flanges so that when said flanges are moved towards each other, the closest distance assumable between said flanges is determined by the extent to which said surfaces are positioned between said flanges.

5. The device as claimed in claim 4, wherein said second member has a convexly curved exterior surface and said limit means is pivotally attached to said exterior surface between said ear portions of said second member.

6. The device as claimed in claim 4, wherein said limit means includes a first and a second arm, each arm having an end thereof pivotally attached on said exterior surface to one of said ear portions of said second member with said arms extending toward each other, each arm having a wedge member having said converging surfaces formed thereon, each wedge member having shoulder means protruding from said base of said converging surfaces for engaging said first and second members.

7. The device as claimed in claim 6, wherein said arms each have a side from which said wedge member extends and an opposite side, said locking means having one end secured to said opposite side of one of said arms and its other end secured to said opposite side of the other of said arms.

8. The device as claimed in claim 7, wherein said locking means includes adjustable means for holding said arms in a selected position relative to each other.

* * * * *